US008926054B2

(12) United States Patent
Emoto et al.

(10) Patent No.: US 8,926,054 B2
(45) Date of Patent: Jan. 6, 2015

(54) CONVEYANCE APPARATUS AND METHOD FOR CALCULATING CONVEYANCE CORRECTION VALUE

(71) Applicant: Canon Kabushiki Kaisha, Tokyo (JP)

(72) Inventors: Yuki Emoto, Tokyo (JP); Junichi Hirate, Kawasaki (JP); Kiyoshi Masuda, Kawasaki (JP); Tomoyuki Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/021,816

(22) Filed: Sep. 9, 2013

(65) Prior Publication Data

US 2014/0078211 A1 Mar. 20, 2014

(30) Foreign Application Priority Data

Sep. 14, 2012 (JP) ..... 2012-203097

(51) Int. Cl.
*B41J 29/393* (2006.01)
*B41J 11/46* (2006.01)
*B41J 13/00* (2006.01)

(52) U.S. Cl.
CPC ..... *B41J 13/0009* (2013.01); *B41J 11/46* (2013.01); *B41J 13/0027* (2013.01)
USPC ..... 347/19; 347/16

(58) Field of Classification Search
USPC ..... 347/16, 19, 101, 105
See application file for complete search history.

(56) References Cited

FOREIGN PATENT DOCUMENTS

JP 2008-30455 A 2/2008

*Primary Examiner* — Lamson Nguyen
(74) *Attorney, Agent, or Firm* — Canon USA, Inc., IP Division

(57) ABSTRACT

Based on a conveyance amount in a second conveyance state where a sheet is conveyed by both a first conveyance unit and a second conveyance unit being a conveyance amount obtained by subjecting a conveyance amount in a first conveyance state where the sheet is conveyed only by the first conveyance unit and a conveyance amount in a third conveyance state where the sheet is conveyed only by the second conveyance unit to weighted average with difficulty of slipping of the first or second conveyance unit to the sheet as a weighting coefficient, a remaining conveyance amount is calculated from any two conveyance amounts from among conveyance amounts of the first, the second and the third conveyance states, and a correction value for conveyance is set from the calculated conveyance amount.

9 Claims, 11 Drawing Sheets

FIG. 10

| | CONVEYANCE AMOUNT T | CONVEYANCE CHARACTERISTIC COEFFICIENT $\alpha$ | CONVEYANCE-AMOUNT CORRECTION VALUE S |
|---|---|---|---|
| FIRST CONVEYANCE STATE (ONE SHAFT: CONVEYANCE ROLLER) | TLF | $\alpha$LF | SLF |
| SECOND CONVEYANCE STATE (TWO SHAFTS: CONVEYANCE ROLLER AND DISCHARGE ROLLER) | TLFEJ | | SLFEJ |
| THIRD CONVEYANCE STATE (ONE SHAFT: DISCHARGE ROLLER) | TEJ | $\alpha$EJ | SEJ |

FIG. 11

| CONVEYANCE STATE | CONVEYANCE AMOUNT T | CONVEYANCE CHARACTERISTIC COEFFICIENT $\alpha$ | CONVEYANCE-AMOUNT CORRECTION VALUE S |
|---|---|---|---|
| CA | TA | $\alpha$B | SA |
| CB | TB | $\alpha$C | SB |
| CC | TC | $\alpha$C | SC |
| CAB | TAB | | SAB |
| CBC | TBC | | SBC |
| CABC | TABC | | SABC |

CONVEYANCE APPARATUS AND METHOD FOR CALCULATING CONVEYANCE CORRECTION VALUE

BACKGROUND

1. Field

Aspects of the present invention generally relate to a configuration and control of a conveyance apparatus in a recording apparatus which causes a conveyance unit to pinch and convey a recording medium to perform a recording operation.

2. Description of the Related Art

In recent years, an image forming apparatus such as a copying machine or a printer has many opportunities to print a photographic image. In particular, in an ink-jet image forming apparatus, an image can be formed in a quality equal to that of a silver halide photograph because of smaller liquid droplets of ink or an improvement in an image processing technique.

The demand accuracy of a mechanism part in a recording apparatus is very high in the context of the demand for the high image quality. In particular, for a roller which conveys a recording medium, it is generally known that a conveyance amount of the recording medium is approximately proportional to an outer diameter of the roller which conveys the recording medium. Very high accuracy is thus demanded for the roller. However, because the processing accuracy of the part has its limit, and the accuracy enhancement of the part causes an increase in a manufacturing cost, there is need for a technique for executing high-quality image recording without depending on the accuracy of the part.

Generally, a main recording unit of a recording apparatus includes a recording head, and a plurality of conveyance rollers provided on an upstream side or a downstream side of the recording head. While the recording medium is held and conveyed by the plurality of conveyance rollers, recording is performed on the recording medium by the recording head. A conveyance amount of a recording medium is changed according to a conveyance condition such as switching of a roller which conveys the recording medium in the conveyance of the recording medium in the recording apparatus. Consequently, it is necessary to correct the conveyance amount according to each conveyance condition to execute the high-quality image recording over the entire region of the recording medium.

Japanese Patent Application Laid-Open No. 2008-30455 discusses a method for correcting conveyance of a recording medium in order to correspond to the above-described issue. The method records a pattern on a sheet, reads the recorded pattern to actually measure a conveyance amount, and performs correction using a correction value calculated from the actual measured value. In this correction method, a technique is discussed which shifts a nozzle to be used to a conveyance downstream side at the timing at which a trailing edge of a recording medium comes off from a conveyance roller located on an upstream side of a conveyance direction to a recording head in order to record as many patterns as possible over the entire region of the recording medium.

In the technique for correcting the conveyance of the recording medium, involving the reading of the pattern, it is also necessary to consider shortening of a measurement time involving the actual measurement of the conveyance amount in addition to highly accurate correction of each conveyance condition. If the measurement time is longer, for example, when actual measurement is performed at the site where an apparatus is manufactured, such as in a factory, a time related to the manufacture of the apparatus is longer, which accordingly leads to an increase in a manufacturing cost. Even when actual measurement is performed in a user's site, the user may feel stress about the length of the measurement time. Therefore, it is important that the correction can be performed with high accuracy in a measurement time which is as short as possible.

However, it is difficult to achieve both the securement of the correction accuracy and the shortening of the measurement time in the technique discussed in Japanese Patent Application Laid-Open No. 2008-30455. This is because the recording apparatus described in Japanese Patent Application Laid-Open No. 2008-30455 performs actual measurement in the entire region between the leading edge and trailing edge of the recording medium, which increases the measurement time. Consequently, it is desirable to perform actual measurement in not the entire region but an appropriately selected region in order to shorten the measurement time, and to estimate the conveyance amount in the other condition based on the actual measurement.

SUMMARY

Aspects of the present invention are generally directed to a reduction in labor and time for actual measurement of a conveyance amount for obtaining a correction value for conveyance.

According to an aspect of the present invention, a conveyance apparatus includes a first conveyance unit configured to convey a sheet in a conveyance direction and a second conveyance unit disposed at a position downstream of the conveyance direction from the first conveyance unit and configured to convey the sheet in the conveyance direction. Based on a conveyance amount in a case where a sheet is conveyed by both the first conveyance unit and the second conveyance unit being a conveyance amount obtained by subjecting a conveyance amount in a case where the sheet is conveyed only by the first conveyance unit and a conveyance amount in a case where the sheet is conveyed only by the second conveyance unit to weighted average with difficulty of slipping of the first or second conveyance unit to the sheet as a weighting coefficient, a remaining conveyance amount is calculated from any two conveyance amounts from among the conveyance amount in the case where the sheet is conveyed by both the first conveyance unit and the second conveyance unit, the conveyance amount in the case where the sheet is conveyed only by the first conveyance unit, and the conveyance amount in the case where the sheet is conveyed only by the second conveyance unit, and a correction value for conveyance is set from the calculated conveyance amount.

According to the present disclosure, the labor and time for actual measurement of the conveyance amount for obtaining the correction value for conveyance can be reduced.

Further features of the present disclosure will become apparent from the following description of exemplary embodiments with reference to the attached drawings.

BRIEF DESCRIPTION OF THE DRAWINGS

FIG. 10 is a table which stores conveyance-amount correction values and values required for calculating the conveyance-amount correction values in respective conveyance states according to the first exemplary embodiment.

FIG. 11 is a table which stores conveyance-amount correction values and values required for calculating the conveyance-amount correction values in respective conveyance states according to the second exemplary embodiment.

DESCRIPTION OF THE EMBODIMENTS

Figure 1:
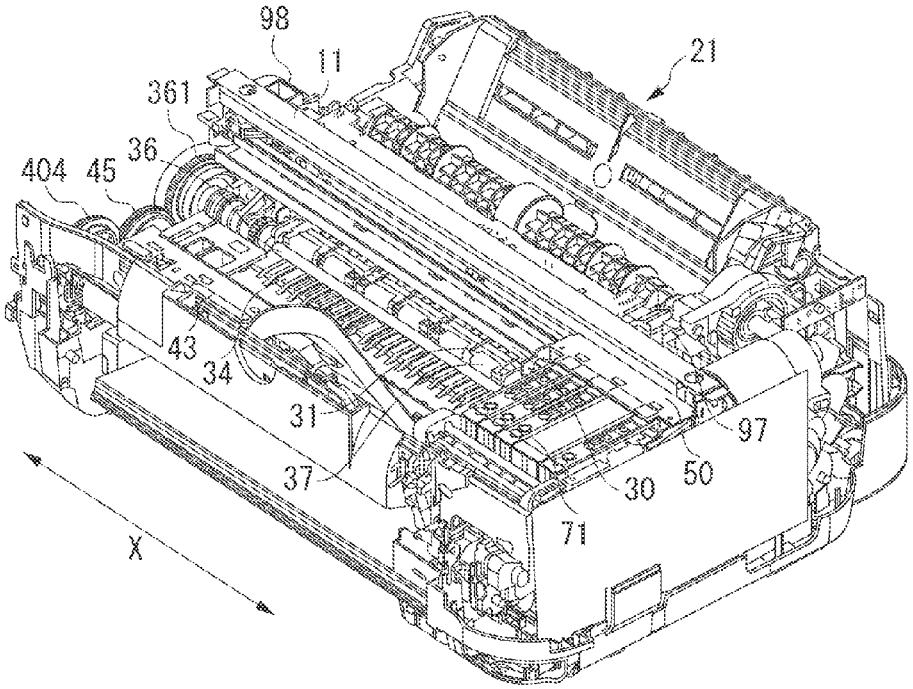
FIG. 1 is a perspective view of a mechanism unit in a recording apparatus according to a first exemplary embodiment.

FIG. 1 is a perspective view of a mechanism unit of a recording apparatus according to a first exemplary embodiment.

(A) Recording Unit

A recording unit records an image on a recording medium, which is a sheet, by a recording head 7 mounted on a carriage 50. The recording medium conveyed by a sheet conveyance unit, which is described below, is supported by a platen 34 from below. An image based on recording image information is recorded by ink discharged from the recording head 7 located above the recording medium. The carriage 50 on which the recording head 7 and an ink tank 71 for supplying ink to the recording head 7 are mounted is movable in a scanning direction which intersects a conveyance direction indicated by X in FIG. 1. The carriage 50 performs image recording in a width direction of the recording medium while moving in the scanning direction.

(B) Sheet Conveyance Unit

The sheet conveyance unit is disposed on a downstream side in the conveyance direction of a sheet feeding unit 21, and conveys recording media separated one by one and fed, with high accuracy. The main mechanism of the sheet conveyance unit is attached to a chassis 11 formed by bending a sheet metal and chassis 97 and 98 formed by molding. In the sheet conveyance unit, the recording medium is conveyed by a conveyance roller 36 and a discharge roller 40, which is described below. The conveyance roller 36 and the discharge roller 40 respectively correspond to a first conveyance roller and a second conveyance roller according to the present embodiment. The conveyance roller 36 is formed by coating a surface of a metal shaft with ceramic micro-particles, and includes metal portions at the ends thereof. The metal portions of the conveyance roller 36 are supported by bearing portions attached to the chassis 97 and 98. A plurality of pinch rollers 37 are held by a pinch roller holder 30 and are urged against a surface of the conveyance roller 36 by a pinch roller spring 31. The pinch rollers 37 are in contact with the surface of the conveyance roller 36, and are rotated by the rotation of the conveyance roller 36.

Figure 2:
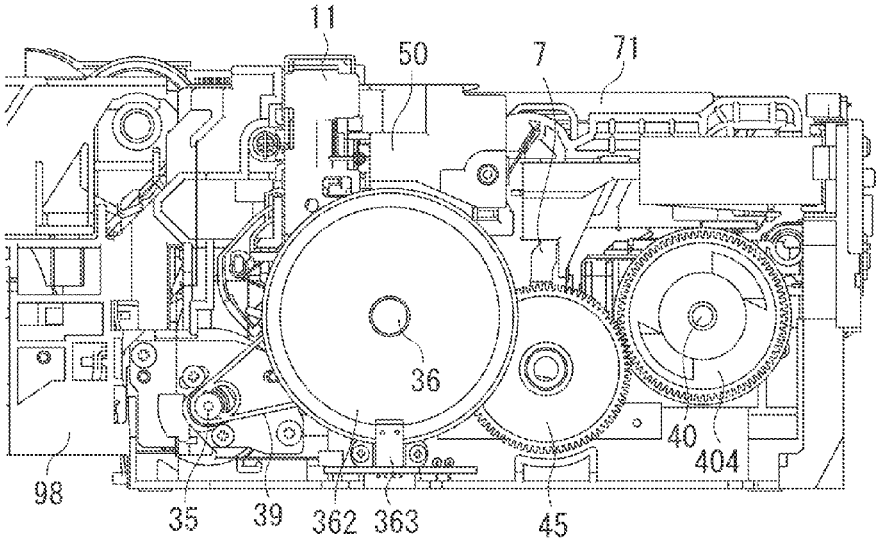
FIG. 2 is a side view particularly illustrating a conveyance mechanism including a sheet conveyance unit in the recording apparatus according to the first exemplary embodiment.
Figure 3:
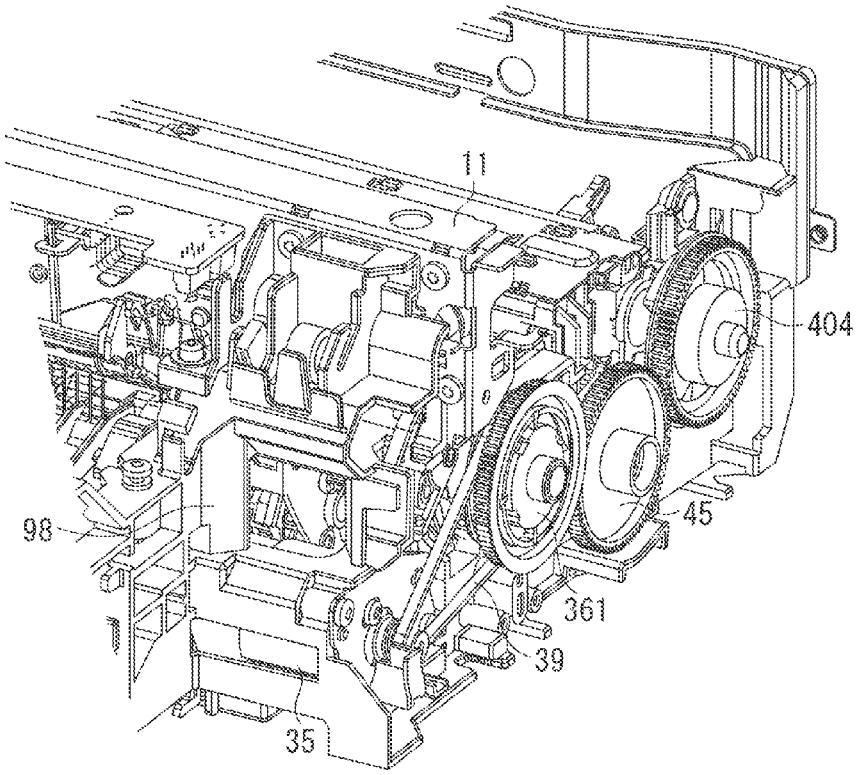
FIG. 3 is a perspective view particularly illustrating the conveyance mechanism including the sheet conveyance unit in the recording apparatus according to the first exemplary embodiment.

FIGS. 2 and 3 are a side view and a perspective view particularly illustrating a conveyance mechanism including the sheet conveyance unit in the recording apparatus according to the present exemplary embodiment. The conveyance roller 36 receives a rotational force when a driving force of a conveyance motor 35, which is a direct current (DC) motor, is transmitted to a pulley gear 361 provided on a shaft of the conveyance roller 36 via a timing belt 39. A code wheel 362 in which slits are formed at a pitch of 150 lpi to 360 lpi is directly connected to the conveyance roller 36 such that the code wheel 362 is coaxial with the conveyance roller 36. A conveyance-roller encoder sensor 363 is fixed to the chassis 98 at a position illustrated in FIG. 2 which corresponds to the slits on the code wheel 362. According to the present exemplary embodiment, the conveyance-roller encoder sensor 363 counts the number of the slits on the code wheel 362 to manage rotation amounts of the conveyance roller 36 and the discharge roller 40, which is described below, in common.

The pulley gear 361 includes a pulley unit and a gear unit. A driving force is transmitted from the gear unit to a discharge roller gear 404 via an idler gear 45, and thus the discharge roller 40 is driven. The discharge roller 40 includes a rubber roller provided on the metal shaft. A plurality of spurs are attached to a spur holder 43 provided at a position facing to the discharge roller 40, and are pressed toward the discharge roller 40 by a spur spring which is a rod-like coil spring.

According to the present exemplary embodiment, a rotational speed ratio between the conveyance roller 36 and the discharge roller 40 is 1:1. In addition, the rotational speed ratio is also 1:1 for each of the pulley gear 361, the idler gear 45, and the discharge roller gear 404 which function as a transmitting unit for transmitting a driving force to the conveyance roller 36 and the discharge roller 40. With this structure, rotation periods of the conveyance roller 36, the discharge roller 40, and transmission gears are equal to each other. Thus, if the conveyance roller 36 is rotated once, the discharge roller 40 and the transmission gear are also rotated once. More specifically, a period of an error in a conveyance amount which is generated by eccentricity of the roller, a transmission error of the gear, and the like and varied in accordance with the rotational phase of each roller and gear takes a round for one rotation of the conveyance roller 36.

A conveyance operation when an image is recorded will be described with reference to FIGS. 4A to 4C while focusing on a change in a conveyance state. As described above, a recording medium is conveyed to record an image while the rollers conveying the recording medium take a turn. A fed recording medium P is guided to a paper guide 38 and the pinch roller holder 30, and a leading edge of the recording medium P enters the conveyance roller 36.

Figure 4A:
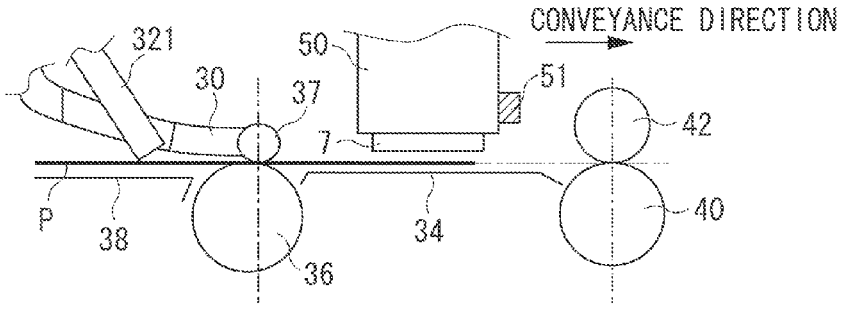
FIGS. 4A to 4C are schematic cross-sectional views illustrating a change in a state of a conveyance operation when an image is recorded in the recording apparatus according to the first exemplary embodiment.
Figure 4B:
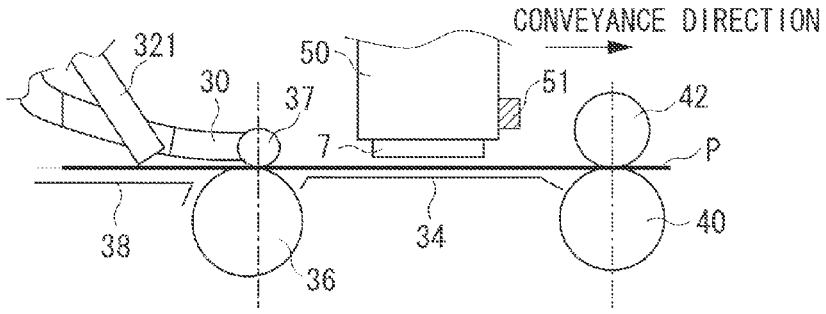
Figure 4C:
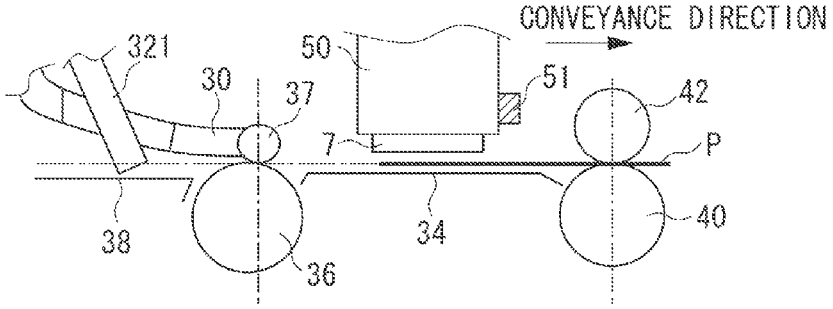

When an image is recorded on a leading edge region of the recording medium P, as illustrated in FIG. 4A, the recording medium P is conveyed only by the conveyance roller 36. When the image is recorded on an intermediate region of the recording medium P, as illustrated in FIG. 4B, the leading edge of the recording medium P enters the discharge roller 40, and the recording medium P is conveyed by both the conveyance roller 36 and the discharge roller 40. When the image is recorded on a trailing edge region of the recording medium P, as illustrated in FIG. 4C, the trailing edge of the recording medium P passes through the conveyance roller 36, and the recording medium P is conveyed only by the discharge roller 40.

These three conveyance states are referred to as a first conveyance state (only the conveyance roller 36 is rotated), a second conveyance state (both the conveyance roller 36 and the discharge roller 40 are rotated), and a third conveyance state (only the discharge roller 40 is rotated). Thus, because the rollers related to the conveyance of the recording medium are different according to the difference of the region of the recording medium on which the image is recorded, it is necessary to control the conveyance amount according to each conveyance state. The timing at which each conveyance state is switched is calculated by an edge sensor 321 for detecting the edge of the recording medium provided on the pinch roller holder 30 based on detection information of the edge sensor 321.

(C) Control System

Figure 5:
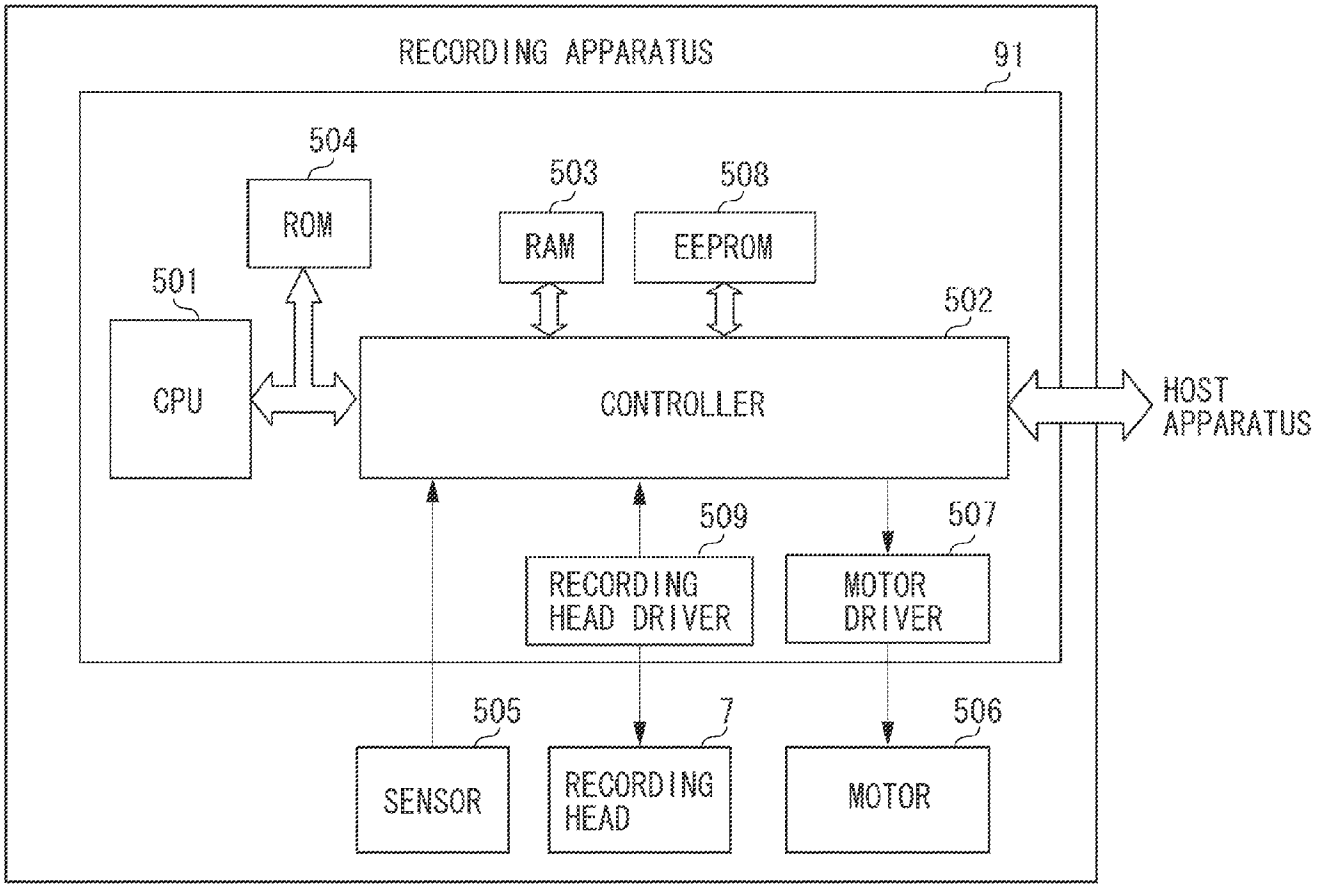
FIG. 5 is a control block diagram of the recording apparatus according to the first exemplary embodiment.

FIG. 5 is a block diagram illustrating a configuration of a control unit 91 in the recording apparatus according to the present exemplary embodiment. A central processing unit (CPU) 501 controls various mechanisms in the apparatus via a controller 502 based on various programs stored in a read-only memory (ROM) 504. In this case, a random access memory (RAM) 503 is used as a work area for temporarily storing various data pieces or for executing processes. Image data is transmitted from an external host apparatus which is connected to the recording apparatus, and the CPU 501 performs image processing for converting the image data into a recording signal with which the recording apparatus can perform the recording operation. Various motors 506 are driven by a motor driver 507, and the recording head 7 is driven by a recording head driver 509, so that an image is recorded on a recording medium. In FIG. 5, the motor 506 collectively represents a plurality of motors such as the conveyance motor 35 and a motor for driving the carriage 50, and the motor driver 507 collectively represents the motor drivers thereof.

An electrically erasable programmable read-only memory (EEPROM) 508 stores setting values set in a factory or on a user site and data to be updated, and these data pieces are used by the controller 502 and the CPU 501 as control parameters. A sensor 505 collectively represents temperature sensors and encoder sensors disposed at various positions in the apparatus, and the above-described conveyance-roller encoder sensor 363 is also included in the sensor 505. The CPU 501 increments counter information in a ring buffer in the RAM 503 each time a slit is detected by the conveyance-roller encoder sensor 363. Calculation formulae for calculating the one remaining conveyance amount from two conveyance amounts, which are described below, are stored in the ROM 504. The conveyance amount, a conveyance-amount correction value, and the like which are obtained by actual measurement or calculation are stored in the EEPROM 508. The conveyance amount is corrected while these formulae and values are suitably referred to or calculated.

Then, the calculation formulae for calculating the conveyance amount in the one remaining conveyance state from the conveyance amounts of the two conveyance states which characterizes the present embodiment will be described.

In the description herein, a conveyance amount when the conveyance roller 36 and the discharge roller 40 cooperatively convey the recording medium is calculated on the assumption that the respective conveyance amounts of the conveyance roller 36 and the discharge roller 40 are known when the conveyance roller 36 and the discharge roller 40 are respectively rotated by the same predetermined rotation amount. More specifically, the case of calculating the conveyance amount in the second conveyance state from the respective conveyance amounts in the first and third conveyance states will be described.

A conveyance amount (conveyance distance) with respect to a predetermined rotation amount (predetermined rotation angle) of the conveyance roller (i.e. LF roller) is defined as βLF, and a conveyance amount (conveyance distance) with respect to a predetermined rotation amount predetermined rotation angle) of the discharge roller (i.e., EJ roller) is defined as βEJ. These two conveyance amounts βLF and βEJ are respectively actually measured and calculated in advance using techniques for actually measuring the conveyance amount, which are described below. In addition, the conveyance amounts βLF and βEJ meet a relationship of βLF>βEJ (this situation can be easily realized if the diameter of the LF roller is made larger than that of the EJ roller). A conveyance amount when the conveyance roller 36 and the discharge roller 40 cooperatively convey the recording medium is defined as the conveyance amount βLFEJ. The conveyance amount βLFEJ is calculated from the known conveyance amounts βLF and βEJ.

When the conveyance amount (βLF) conveyed only by the conveyance roller 36 is different from the conveyance amount (βEJ) conveyed only by the discharge roller 40, the conveyance amount of the recording medium conveyed by both the conveyance roller 36 and the discharge roller 40 is between the two conveyance amounts. In this case, the following phenomenon occurs in the recording apparatus. The conveyance roller 36 conveying a sheet for a greater amount with respect to the predetermined rotation amount causes a force (forward tension) pressing an outer circumferential surface of the discharge roller 40 conveying the sheet for a less amount in the downstream direction of the conveyance direction via the recording medium to act on the outer circumferential surface of the discharge roller 40. A force for assisting the recording medium in conveyance is applied to the discharge roller 40 from the conveyance roller 36 by the force (forward tension). As a result, the conveyance distance of the recording medium per the predetermined rotation angle (for example, a unit rotation angle) of the discharge roller 40 is apparently increased.

On the other hand, a force equal to the force applied to the discharge roller 40 occurs in an opposite direction (an upstream direction with respect to the conveyance direction) on an outer circumferential surface of the conveyance roller 36 from the law of action and reaction (back tension). The conveyance distance of the recording medium per the predetermined rotation angle of the conveyance roller 36 (for example, the unit rotation angle) is apparently decreased by the back tension. The forces are applied and received between the rollers via the recording medium so that the conveyance amounts of both the rollers per the unit rotation angle are apparently equal to each other. Consequently, the conveyance amount βLFEJ is between the conveyance amounts βLF and βEJ. Because the force is made to interact between the rollers, the conveyance amount βLFEJ is influenced by a conveyance characteristic to an external force (load) of each roller.

The conveyance characteristic to the load will be described. Regarding the conveyance amount of the recording medium, it is known that if a load is generated via the recording medium, the recording medium slips to decrease a feed amount. How much slip is generated to a load of a weight can be easily obtained in an experiment by actually measuring the conveyance amount of the recording medium when hanging a weight having a known weight and rotating the roller by the predetermined rotation angle while applying the load to the recording medium. For example, a graph illustrated in FIG. 9 can be obtained in the experiment.

Figure 9:
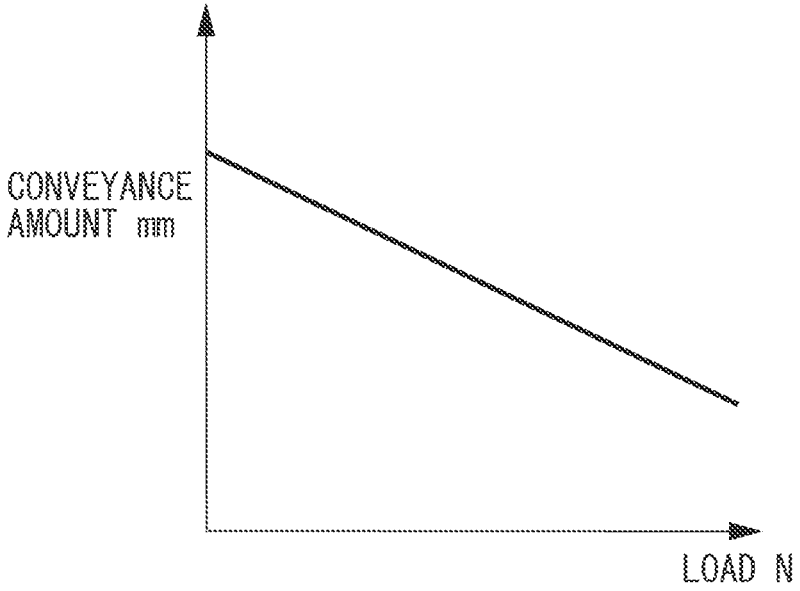
FIG. 9 illustrates a relationship between a load and a conveyance amount when a recording medium is conveyed.

Thus, as the load is increased, a slip amount is increased, which decreases the conveyance amount per the predetermined rotation angle. A value of the inclination of the graph illustrated in FIG. 9 is referred to as a conveyance characteristic coefficient α. The conveyance characteristic coefficient α is a value indicating a slip amount to the load.

To describe specifically, the conveyance characteristic coefficient α is calculated according to {(conveyance amount when load is applied)−(conveyance amount when load is not applied)}/(magnitude of load). Consequently, the conveyance characteristic coefficient α is expressed in the unit of (mm/N), and has a negative value. The conveyance characteristic coefficient α can be obtained in the experiment for the conveyance roller 36 and the discharge roller 40, respectively. The values are defined as αLF and αEJ.

As described above, because the conveyance amount βLFEJ in the two shafts, i.e. the conveyance roller 36 and the discharge roller 40, is the conveyance amount when the load is applied to each roller, the conveyance amount βLFEJ can be expressed by the formula using the conveyance characteristic coefficient α for each roller. Consequently, when, for the force made to interact between the rollers, a load applied to the conveyance roller 36 is defined as FLF, and a load applied to the discharge roller 40 is defined as FEJ, the conveyance amount βLFEJ can be described in the forms of a formula 1 and a formula 2 for each roller.

$$\beta LFEJ=\alpha LF\times FLF+\beta LF \quad \text{(formula 1)}$$

$$\beta LFEJ=\alpha EJ\times FEJ+\beta EJ \quad \text{(formula 2)}$$

For the relationship between the loads FLF and FEJ, FLF=−FEJ is set from the law of action and reaction. When the formula 1 and the formula 2 are converted using the relationship, the conveyance amount βLFEJ can be expressed by the form of a formula 3 using the conveyance amounts βLF and βEJ, and the conveyance characteristic coefficients αLF and αEJ.

$$\beta LFEJ=((1/\alpha LF)/((1/\alpha LF)+(1/\alpha EJ)))\times\beta LF+((1/\alpha LF)/((1/\alpha LF)+(1/\alpha EJ)))\times\beta EJ \quad \text{(formula 3)}$$

From the formula 3 thus derived, it can be understood that the conveyance amount βLFEJ is obtained by subjecting the conveyance amounts βLF and βEJ to weighted average using 1/αLF and 1/αEJ.

Because the conveyance characteristic coefficient α is a numerical value expressing the slip amount to the load, a reciprocal number 1/α is a numerical value indicating difficulty of slipping to the load. Thus, the value 1/α indicating the difficulty of slipping to the load is referred to as a conveyance strength. Therefore, the conveyance amount βLFEJ when the rollers perform cooperative conveyance can be calculated by weighted average using the conveyance strengths (difficulty of slipping) γLF (=1/αLF) and γEJ (=1/αEJ) of the rollers for the conveyance amounts βLF and βEJ of the respective rollers.

$$\beta LFEJ=(\gamma LF/(\gamma LF+\gamma EJ))\times\beta LF+(\gamma EJ/(\gamma LF+\gamma EJ))\times\beta EJ \quad \text{(formula 4)}$$

Then, a method for calculating the conveyance-amount correction value in each of the conveyance operations of the first, second, and third conveyance states using the above calculation formulae will be described. The conveyance-amount correction value is calculated in the factory or the user's site before actual printing is performed.

In the basic procedure of the method for calculating the correction value in each state, first, a recording medium is conveyed in a state where the rotation amount of the roller is managed. The conveyance amount of the recording medium in any two conveyance states among the three conveyance states is actually measured. The conveyance amount for the predetermined rotation amount is converted from the actually measured result. Then, a conveyance amount in the one remaining conveyance state is calculated from the conveyance amounts in the obtained two conveyance states using the formula 3 or the formula 4. Then, conveyance-amount correction values in the three conveyance states are calculated based on the three conveyance amounts. According to the present exemplary embodiment, the case where the conveyance amount in only the conveyance roller 36 which is in the first conveyance state is actually measured, and the conveyance amount in only the discharge roller 40 which is in the third conveyance state are actually measured will be described. A conveyance amount in the two shafts, namely the conveyance roller 36 and the discharge roller 40 which are in the second conveyance state is calculated by these two actually measured results.

FIG. 10 is a table which stores conveyance-amount correction values and values required for calculating these conveyance-amount correction values in the respective conveyance states according to the first exemplary embodiment. In FIG. 10, conveyance amounts TLF, TLFEJ, and TEJ indicate conveyance amounts for the predetermined rotation amount. According to the present exemplary embodiment, the conveyance amounts TLF, TLFEJ, and TEJ are stored as the conveyance amount for one rotation of the roller. As described above, the conveyance characteristic coefficients αLF and αEJ indicate the slip amount to the load, and are stored in advance. Conveyance-amount correction values SLF, SLFEJ, and SEJ are stored correction values, which are described below.

Figure 6:
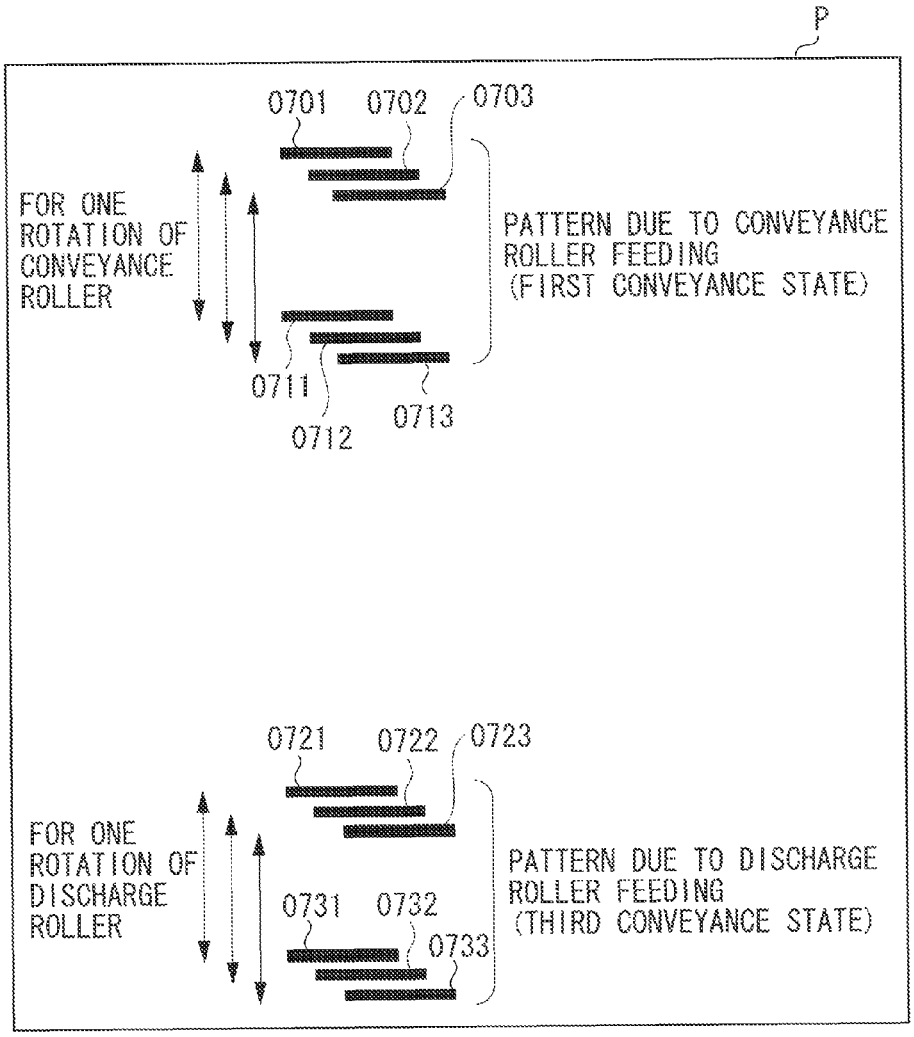
FIG. 6 illustrates an example of test patterns for actually measuring a conveyance amount in each conveyance state in the recording apparatus according to the first exemplary embodiment.

Then, a method for acquiring the conveyance amount T in the table illustrated in FIG. 10 will be described. FIG. 6 illustrates an example of test patterns for acquiring the conveyance amounts TLF and TEJ related to the first and third conveyance states among the three conveyance amounts.

In recording of the test patterns, first, test pattern is recorded in the conveyance of only the conveyance roller 36 which is in the first conveyance state. After the sheet passes through the conveyance roller 36, and is conveyed to a test pattern recording position, a first test pattern 0701 is recorded. After the pattern recording is ended, the roller is slightly rotated in a state where the roller rotation amount is managed, and a second test pattern 0702 is recorded. Similarly, the roller is slightly rotated, and a third test pattern 0703 is recorded.

After the three patterns are recorded, the sheet is conveyed to a position corresponding to one rotation of the roller from the recording position of the first test pattern 0701, and a fourth test pattern 0711 is recorded. Then, while the roller is rotated as needed to convey the sheet, fifth and sixth test patterns 0712 and 0713 are recorded at positions corresponding to one rotation of the roller from the recording positions of the second and third test patterns 0702 and 0703. Due to the above-described operation, the test pattern recording in the first conveyance state is completed.

An interval between the first test pattern 0701 and the fourth test pattern 0711 (for example, a distance between downstream side edges of both the patterns) corresponds to the conveyance amount for one rotation of the conveyance roller 36. Similarly, an interval between the second and fifth test patterns 0702 and 0712 and an interval between the third and sixth test patterns 0703 and 0713 also correspond to the conveyance amount for one rotation of the conveyance roller 36.

Continuously, the test pattern recording is performed in the conveyance of only the discharge roller 40 which is in the third conveyance state. After the trailing edge of the sheet passes through a nip portion of the conveyance roller 36, and is conveyed to a test pattern recording position, a first test pattern 0721 is recorded. Then, five test patterns 0722 to 0733 are recorded while the roller rotation amount is controlled by the similar method as that of the test pattern recording in the first conveyance state described above. Accordingly, intervals between the test patterns 0721 and 0731, the test patterns 0722 and 0732, and the test patterns 0723 and 0733 correspond to the conveyance amount for one rotation of the discharge roller 40.

After all the test pattern recordings are completed, the sheet on which the patterns are recorded is fed again. The intervals between the test patterns 0701 and 0711, the test patterns 0702 and 0712, and the test patterns 0703 and 0713 are measured by an optical sensor 511 (illustrated in FIG. 4) installed in the carriage 50. Then, the intervals between the test patterns 0721 and 0731, the test patterns 0722 and 0732, and the test patterns 0723 and 0733 are measured by the similar measuring method.

Because the intervals between the test patterns measured above correspond to the conveyance amounts for one rotation of the conveyance roller 36 and the discharge roller 40, the conveyance amounts for one rotation of the conveyance roller 36 and the discharge roller 40 can be acquired by measuring these intervals. An average value of the three intervals measured in the region of each of the first and third conveyance states is stored in the respective conveyance amounts TLF and TEJ in the first and third conveyance states. According to the present exemplary embodiment, the three measured intervals are averaged, and stored as the conveyance amount T to reduce an error such as stop variation of the roller assumed during the test pattern recording, or measurement variation assumed during measurement. The conveyance amount is periodically varied according to the rotation phase of the roller by the eccentricity of the roller or the like. Because the correction of a center value in a periodic variation of the unit conveyance amount (conveyance speed) of the roller is considered in the present exemplary embodiment, one period of the rotation of the roller, that is the conveyance amount for one rotation is actually measured and calculated.

Then, the conveyance amount TLFEJ in the second conveyance state where the conveyance amount is not actually measured is calculated and stored. The conveyance amount TLFEJ is calculated according to the formula 3 using the previously stored conveyance characteristic coefficients $\alpha$LF and $\beta$EJ, or the stored conveyance amounts TLF and TEJ. Because the conveyance amounts TLF and TEJ express the conveyance amount per the predetermined rotation amount, the conveyance amount can be calculated by respectively substituting the conveyance amounts TLF and TEJ for the conveyance amounts $\beta$LF and $\beta$EJ of the formula 3. The conveyance amount thus calculated is stored in TLFEJ. Consequently, the conveyance amounts T in the three conveyance states can be obtained.

Then, a conveyance-amount correction value S is stored for each of the conveyance states. More specifically, values obtained by subtracting the measured actual conveyance amounts TLF, TLFEJ, and TEJ of the respective conveyance states from ideal conveyance amounts ITLF, ITLFEJ, and ITEJ for one rotation of the roller at the time of image recording are stored as correction values SLF, SLFEJ, and SEJ.

$$SLF=ITLF-TLF \quad \text{(formula 5)}$$

$$SLFEJ=ITLFEJ-TLFEJ \quad \text{(formula 6)}$$

$$SEJ=ITEJ-TEJ \quad \text{(formula 7)}$$

According to a series of the above-described procedures, the conveyance-amount correction values S in all the three conveyance states can be obtained from the actual measurement of the conveyance amounts in the two conveyance states. Because a conveyance deviation corresponding to the conveyance-amount correction value occurs when the recording medium is actually conveyed for one rotation of the roller, the recording medium can be conveyed by the ideal conveyance amount by adding the rotation amount corresponding to the conveyance-amount correction value.

According to the present exemplary embodiment, the conveyance amounts in the first and third conveyance states are actually measured. However, for example, the conveyance amounts in the second and third conveyance states can be actually measured, and the conveyance amount $\beta$LF can be calculated and obtained based on the stored conveyance amounts $\beta$LFEJ and $\beta$EJ. More specifically, the conveyance amount in the one remaining conveyance state can be calculated according to the formula 3 by actually measuring the conveyance amounts in any two conveyance states among the three conveyance states.

The test pattern is not limited to the pattern illustrated in FIG. 6. The two conveyance states may be arbitrarily selected, and the conveyance amounts may be actually measured by patterns corresponding to the selected conveyance states. Regarding the intervals between the test patterns, for example, one rotation of the roller may be divided, and the conveyance amount may be actually measured by the sum of the intervals. When the predetermined rotation amount which defines the conveyance amount T is different from the rotation amount of the interval between the test patterns, it is necessary to convert the actually measured result into the predetermined rotation amount, and to store the actually measured result.

Figure 7:
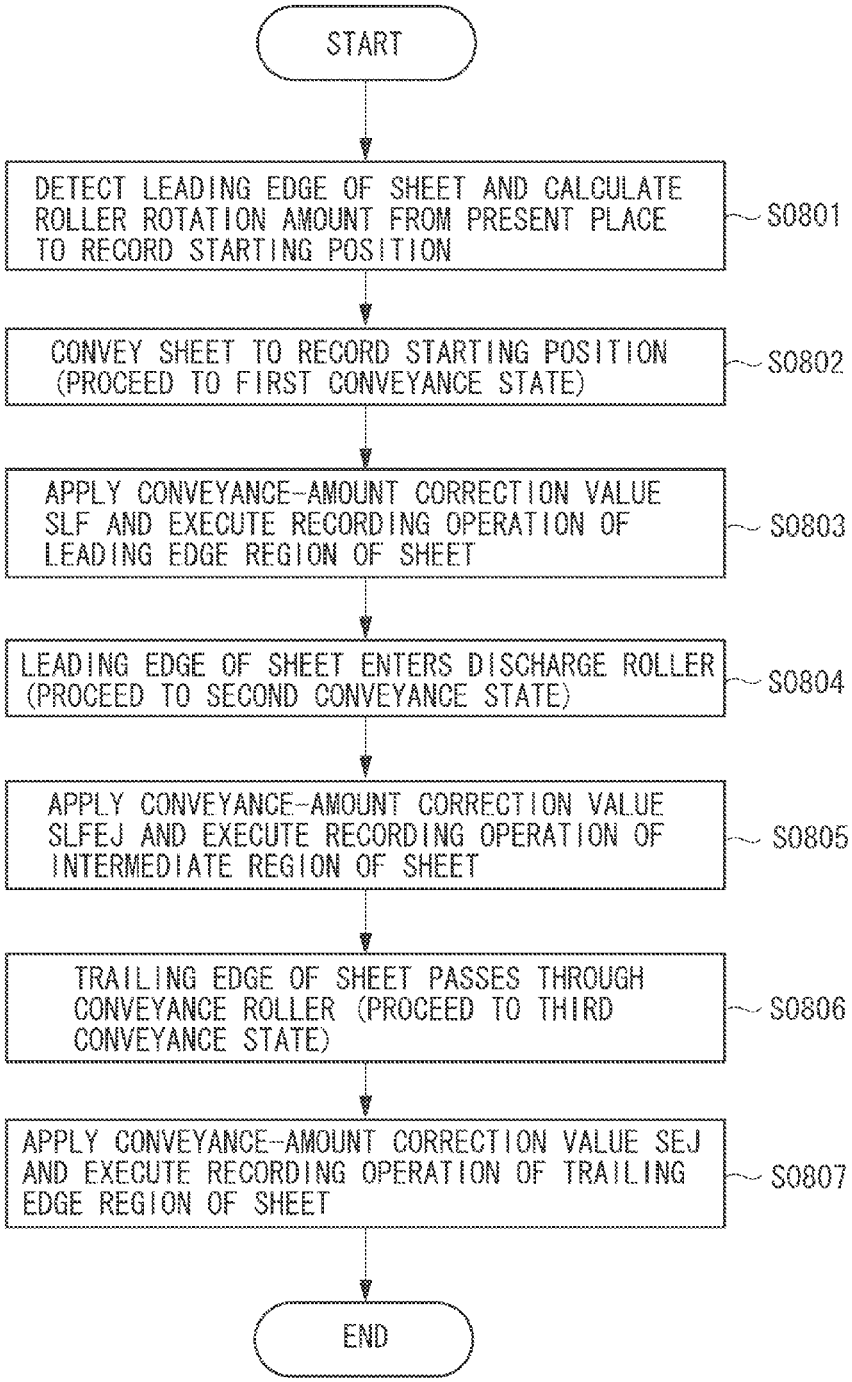
FIG. 7 illustrates a control flowchart for correcting a conveyance amount at the time of a recording operation in the recording apparatus according to the first exemplary embodiment.

Finally, a method for performing conveyance amount correction control in each conveyance state while performing an actual recording operation will be described with reference to FIG. 7. FIG. 7 illustrates a control flowchart for conveyance amount correction in each conveyance state during the actual recording operation.

First, if the recording apparatus receives a signal of an image recording operation, a sheet is fed from the sheet feeding unit 21, and the sheet enters the edge sensor 321 located on the upstream side of the conveyance roller 36. In this case, with reference to FIG. 7, in step S0801, the position of the leading edge of the sheet is detected by the edge sensor 321 to calculate a roller rotation amount to an actual record starting position. Then, in step S0802, the sheet is conveyed based on the calculated roller rotation amount, and the sheet is positioned to the record starting position. In this case, because the leading edge of the sheet passes through the conveyance roller 36, the conveyance of the sheet proceeds to the first conveyance state.

Then, in step S0803, the recording operation is performed on the leading edge region of the sheet. The recording operation is executed by repeating the movement of the recording head 7 by the carriage 50 and the conveyance by the conveyance roller 36. The conveyance-amount correction value SLF is applied in the conveyance of the conveyance roller 36 to adjust the roller rotation amount, and accordingly the conveyance amount correction in the first conveyance state is executed.

More specifically, because the conveyance-amount correction value SLF is the correction value indicating the conveyance deviation from the ideal conveyance amount for one rotation of the roller, the conveyance amount correction is performed by adding the rotation amount corresponding to the conveyance deviation amount using the conveyance-amount correction value SLF to the actual roller rotation amount. When the ideal conveyance amount for one rotation of the roller is defined as L, and the actual roller rotation amount is defined as θ, the rotation amount is calculated by {(SLF/L)×θ}. Consequently, the conveyance of the ideal conveyance amount for the rotation amount q of the roller can be realized by driving the roller by the rotation amount {(1+SLF/L)×θ} corrected by adding the rotation amount.

More specifically, the actual conveyance amount can be brought close to the ideal conveyance amount by correcting the rotation amount (driving amount). As described above, the rotation amount is managed by counting the number of slits on the code wheel 362 by the conveyance-roller encoder sensor 363. The above-described conveyance amount correction by the correction value SLF is continuously performed until the conveyance just before the leading edge of the sheet enters the discharge roller 40. In step S0804, then, the leading edge of the sheet enters the discharge roller 40, and the state proceeds to the second conveyance state.

When the processing reaches to step S0804, then in step S0805, the conveyance-amount correction value applied up to here is switched to the conveyance-amount correction value SLFEJ. The recording operation of the intermediate region of the sheet is executed while the roller rotation amount is adjusted by the correction value SLFEJ. The conveyance amount correction to which the correction value SLFEJ is applied is performed in the similar manner to the correction method by the conversion of the correction value SLF described in step S0803. The conveyance amount correction by the correction value SLFEJ is continuously performed until the conveyance just before the trailing edge of the sheet passes through the conveyance roller 36. The timing at which the trailing edge of the sheet passes through the conveyance roller 36 may be calculated based on a detection position of the leading edge of the sheet and a sheet length input by recorded image information. The timing may be also calculated by newly detecting a position of the trailing edge of the sheet by the edge sensor 321.

Then, when the trailing edge of the sheet passes through the conveyance roller 36, and the state proceeds to the third conveyance state as in step S0806, in step S0807, the conveyance-amount correction value applied is switched to the correction value SEJ. Then, the recording operation of the trailing edge region of the sheet is executed while the conveyance amount is corrected by the correction value SEJ in the similar manner to the above-described correction method. After the recording operation is ended, the image recording of the entire region of the sheet is completed. Then, the sheet on which the image is recorded is discharged on a discharge tray by the discharge roller 40, and the image recording operation is completed.

As described above, according to the present exemplary embodiment, the conveyance amount correction in all the three conveyance states can be performed only by actually measuring the conveyance amounts of the two conveyance states among the three conveyance states having different conveyance amounts during the recording operation to the recording medium. Therefore, a measurement time can be shortened without impairing conveyance accuracy as compared with the case where all the three conveyance states are actually measured. As this effect, manufacturing cost reduction can be expected by shortening a tact time when the conveyance amount is actually measured in the factory or the like, for example. When the conveyance amount is actually measured in the user's site, the conveyance-amount correction value can be acquired without stress by time shortening.

The rotational speed ratio between the conveyance roller 36 and the transmission gear is 1:1 in the configuration according to the present exemplary embodiment. However, the rotational speed ratio between the conveyance roller 36 and the transmission gear is not limited to 1:1. For example, the rotational speed ratio between one rotation of the conveyance roller 36 and the idler gear 45 or the discharge roller 40 may be an integral multiple or a fraction of an integer. When the conveyance amount is actually measured by the test pattern or the like in such a configuration, the conveyance amount for one period of the rotation in each conveyance state is desirably acquired.

For example, even when conveyance roller rotation:discharge roller rotation:idler gear rotation=1:1/m:1/n is set, the conveyance amount for one rotation of the conveyance roller 36 may be actually measured regardless of the rotational speed ratio in the first conveyance state (m and n are integers). However, in the second conveyance state, it is necessary to actually measure the conveyance amount for m×n rotations of the conveyance roller 36. The actually measured conveyance amount is converted into the predetermined rotation amount, and is stored in the conveyance amount T, so that the conveyance-amount correction value S can be obtained.

When a load is applied to the sheet in the sheet conveyance during the test pattern recording described above, it is necessary to convert the actually measured conveyance amount based on the magnitude of the load and to obtain the conveyance amount T. In the case, the conveyance amount can be presumed from the magnitude of the load using the conveyance characteristic coefficient α which indicates the slip amount to the load. Accordingly, if the load is applied to the sheet, the conveyance amount T can be obtained, and the conveyance amount correction in each conveyance state can be executed.

According to the present exemplary embodiment, the calculation of the conveyance amount in a different conveyance state using the conveyance amount based on the actually measured result is described. However, the value to be used for the calculation is not limited to the conveyance amount. For example, the conveyance-amount correction value is previously obtained by actual measurement, and a conveyance-amount correction value in the different conveyance state can also be obtained using the previously obtained conveyance-amount correction value. In the case, the concept of the correction value may be added to the calculation formula described in the present exemplary embodiment to convert the calculation formula.

More specifically, relationships of formulae 8, 9, and 10 can be set from the formulae 5, 6, and 7.

$$TLF=ITLF-SLF \quad \text{(formula 8)}$$

$$TLFEJ=ITLFEJ-SLFEJ \quad \text{(formula 9)}$$

$$TEJ=ITEJ-SEJ \quad \text{(formula 10)}$$

When the formulae 8, 9, and 10 are substituted for the formula 4, a relationship of a formula 11 can be derived.

$$(ITLFEJ-SLFEJ)=(\gamma LF/(\gamma LF+\gamma EJ))\times(ITLF-SLF)+(\gamma EJ/(\gamma LF+\gamma EJ))\times(ITEJ-SEJ) \quad \text{(formula 11)}$$

The ideal conveyance amounts ITLF and ITEJ can be obtained from the diameter of the roller and the rotation angle of the roller. The ideal conveyance amounts ITLF, ITEJ, and ITLFEJ meet the relationship of a formula 12.

$$ITLFEJ=(\gamma LF/(\gamma LF+\gamma EJ))\times ITLF+(\gamma EJ/(\gamma LF+\gamma EJ))\times ITEJ \quad \text{(formula 12)}$$

When the formula 12 is substituted for the formula 11, the relationship of a formula 13 is derived.

$$SLFEJ=(\gamma LF/(\gamma LF+\gamma EJ))\times SLF+(\gamma EJ/(\gamma LF+\gamma EJ))\times SEJ \quad \text{(formula 13)}$$

The correction value when the sheet is conveyed by both the conveyance roller 36 and the discharge roller 40 can be calculated by subjecting the correction value when the sheet is conveyed by each individual roller to weighted average using the conveyance strengths (difficulty of slipping) $\gamma LF$ ($=1/\alpha LF$) and $\gamma EJ$ ($=1/\alpha EJ$) of each roller as weight.

If the two correction values among the correction values SLF, SEJ, and SLFEJ are obtained by actually measuring the conveyance amount, the remaining correction value can be calculated using the formula 11 or 13.

The control illustrated in FIG. 7 is performed using the correction value thus obtained.

The first exemplary embodiment calculates the conveyance amount in the one remaining conveyance state from the actual measurement of the conveyance amounts in the two conveyance states when the two rollers are used to convey a recording medium, and performs the conveyance amount correction in each conveyance state. The concept of calculating the conveyance amount described in the first exemplary embodiment can be applied in not only the case where two rollers are used but also the case where a plurality of rollers are used. Consequently, in a second exemplary embodiment, the case where three rollers are used to convey a recording medium and a conveyance amount in each conveyance state is obtained by actual measurement or calculation will be described.

Figure 8:
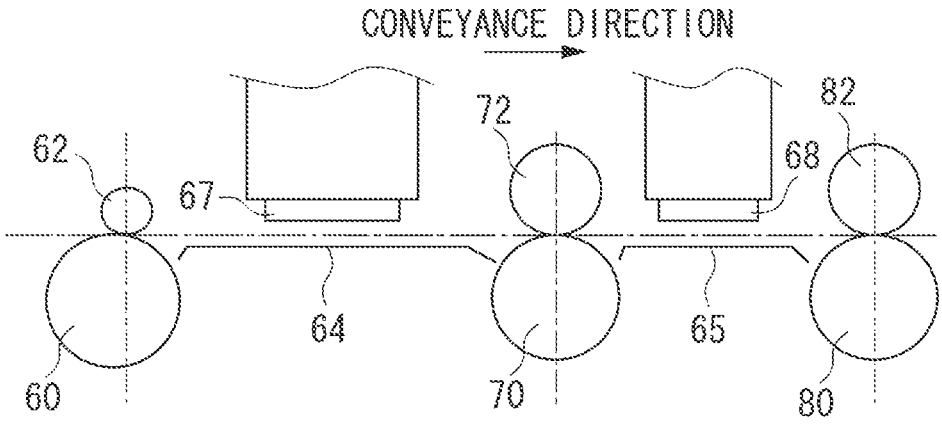
FIG. 8 is a schematic sectional view particularly illustrating a conveyance mechanism including a sheet conveyance unit in a recording apparatus according to a second exemplary embodiment.

FIG. 8 is a schematic sectional view particularly illustrating a conveyance mechanism including a sheet conveyance unit in a recording apparatus according to the second exemplary embodiment. According to the present exemplary embodiment, a recording medium is conveyed using three rollers, i.e., an upstream roller 60, an intermediate roller 70, and a downstream roller 80. A fed recording medium is guided by a guide member (not illustrated), and enters an upstream roller pair including the upstream roller 60 and a pinch roller 62 and is conveyed. The recording medium conveyed by the upstream roller pair enters an intermediate roller pair including the intermediate roller 70 and an intermediate spur 72 and is further conveyed. Then, the recording medium enters a downstream roller including the downstream roller 80 and a downstream spur 82. Thus, while the upstream roller 60, the intermediate roller 70, and the downstream roller 80 perform a conveyance operation, image recording is suitably performed by recording heads 67 and 68, and an image is recorded on the recording medium. When the image recording is completed, the recording medium is finally discharged to a discharge tray (not illustrated) by the downstream roller 80.

When an image is recorded, a recording medium is conveyed while a conveyance state is changed. As the conveyance state of the recording medium, a conveyance state where the recording medium is conveyed only by the upstream roller 60 is defined as a conveyance state CA; a conveyance state where the recording medium is conveyed only by the intermediate roller 70 is defined as a conveyance state CB; and a conveyance state where the recording medium is conveyed only by the downstream roller 80 is defined as a conveyance state CC. Further, for a conveyance state in two shafts, a conveyance state where the recording medium is conveyed by the two shafts, i.e., the upstream roller 60 and the intermediate roller 70 is defined as a conveyance state CAB. A conveyance state where the recording medium is conveyed by the two shafts, i.e., the intermediate roller 70 and the downstream roller 80 is defined as a conveyance state CBC. Furthermore, for a conveyance state in three shafts, a conveyance state where the recording medium is conveyed by the three shafts, i.e., the upstream roller 60, the intermediate roller 70, and the downstream roller 80 is defined as a conveyance state CABC. Depending on a length of the recording medium in the conveyance direction, the conveyance according to the present exemplary embodiment is executed by a maximum of the six conveyance states.

FIG. 11 illustrates a table which stores conveyance-amount correction values and values required for calculating these correction values in the respective conveyance states according to the present exemplary embodiment.

As indicated in FIG. 11, a conveyance amount T for a predetermined rotation amount, a conveyance characteristic coefficient $\alpha$, and a conveyance-amount correction value S are provided for each conveyance state. Because the conveyance characteristic coefficient $\alpha$ is a value which indicates a slip amount to a load for each individual roller as described above, the conveyance characteristic coefficient $\alpha$ is set only in the conveyance states CA, CB, and CC which are conveyance states due to only one roller. For the calculation of the correction value, the conveyance amount T in the remaining conveyance state is calculated from the conveyance amounts T which are stored based on the actually measured results of the plurality of conveyance states, and the conveyance-amount correction value S in each conveyance state is obtained. When an image is recorded, roller rotation control for the conveyance amount correction is performed using the conveyance-amount correction value S according to the conveyance state.

A method for calculating a conveyance amount in each conveyance state will be described. A basic concept of calculation of the conveyance amount is similar to that described above. More specifically, the concept is based on the relationship "the cooperative conveyance amount of a plurality of conveyance units is a conveyance amount obtained by subjecting the conveyance amount of each conveyance unit to weighted average with difficulty of slipping of each conveyance unit to a load as a weighting coefficient". The first exemplary embodiment describes the case where the two rollers are related to the conveyance. However, the concept can be applied even when not only the two rollers but also more rollers are related to the conveyance.

First, for the conveyance amount in the conveyance state to which the two rollers are related, i.e., the conveyance amounts TAB and TBC in the conveyance states CAB and CBC, the following formulae 14 and 15 can be described in the similar form to the formula 3 in the first exemplary embodiment.

$$TAB=((1/\alpha A)/((1/\alpha A)+(1/\alpha B)))\times TA+((1/\alpha B)/((1/\alpha A)+(1/\alpha B)))\times TB \quad \text{(formula 14)}$$

$$TBC=((1/\alpha B)/((1/\alpha B)+(1/\alpha C)))\times TB+((1/\alpha C)/((1/\alpha B)+(1/\alpha C)))\times TC \quad \text{(formula 15)}$$

The conveyance amount in the conveyance state to which the three rollers are related, i.e., the conveyance amount TABC in the conveyance state CABC can be described in the form of the following formula 14 based on the same concept. More specifically, the conveyance amount TABC is expressed by subjecting conveyance amounts TA, TB, and TC to weighted average according to conveyance strengths $1/\alpha A$, $1/\alpha B$, and $1/\alpha C$.

$$TABC=((1/\alpha A)\times TA+(1/\alpha B)\times TB+(1/\alpha C)\times TC)/((1/\alpha A)+(1/\alpha B)+(1/\alpha C)) \quad \text{(formula 16)}$$

The conveyance amounts in all the conveyance states related to the image recording can be calculated by actually measuring the conveyance amounts in the suitable number of the conveyance states according to the formulae 14, 15, and 16. The conveyance characteristic coefficients $\alpha A$, $\alpha B$, and $\alpha C$ are stored in advance as in the first exemplary embodiment. Therefore, if the conveyance amounts TA, TB, and TC are obtained by actual measurement, all the right sides of the three calculation formulae: the formulae 4 and 5; the formulae 6 and 7; and the formulae 8, 9, and 10 are known. Consequently, the conveyance amounts in all the conveyance states can be obtained. More specifically, the conveyance-amount correction values S in all the six conveyance states can be obtained by actually measuring the conveyance amounts in the three conveyance states, and the conveyance amount correction in all the conveyance states can be performed.

When a length of a sheet to be used in the actual measurement of the conveyance amount is longer than an interval between the upstream roller 60 and the downstream roller 80, the conveyance state CB where the sheet is conveyed only by the intermediate roller 70 does not exist. Also in this case, the conveyance amounts in all the conveyance states can be obtained from the actual measurement of the conveyance amounts in the three conveyance states of the following combinations. For example, if the conveyance amounts TA and TC as well as the conveyance amount TAB are obtained by the actual measurement, the conveyance amount TB can be calculated according to the formula 14. Then, if the formulae 15 and 16 are solved using the calculated conveyance amount TB, the conveyance amounts in all the conveyance states can be obtained. Further when the conveyance amounts TA, TAB, and TABC are obtained by the actual measurement, all the conveyance amounts can be obtained by the similar method. Therefore, when the three rollers are used to convey the recording medium, the conveyance amounts in all the remaining conveyance states can be obtained from the actual measurement of the conveyance amounts in the appropriately selected three conveyance states.

The present exemplary embodiment describes the case where the three rollers are used. However, even when more rollers are used, the conveyance amounts in all the conveyance states can be obtained by actually measuring the conveyance amounts in the conveyance states of the number of the used rollers. For example, when "n" pieces of rollers are used to convey the recording medium, the conveyance states of the maximum number of $\{n\times(n+1)/2\}$ exist. For example, if "n" pieces of conveyance units exist, it is necessary to obtain correction values for the conveyance states of all the combinations of two or more conveyance units which can cooperatively convey a sheet among the "n" conveyance units, and the conveyance state of each individual conveyance unit. However, it is not necessary to actually measure the conveyance amounts in all the conveyance states, and the "n" conveyance states may be actually measured. This is because the calculation formula of the conveyance amount in the conveyance state where the other plurality of rollers cooperatively convey the recording medium can be written by the conveyance amount and the conveyance characteristic coefficient in each roller, and if the conveyance amount in each roller is obtained, all the conveyance amounts can be obtained. Further, if the conveyance amount in an arbitrary roller is not actually measured, conversion can be performed by the conveyance amount in the conveyance state to which the roller is related.

As in the first exemplary embodiment, the value to be used for calculation is not limited to the conveyance amount, and calculation may be performed based on the conveyance-amount correction value. More specifically, the effect of the present embodiment can be exhibited without being limited to the calculation process based on the relationship "the cooperative conveyance amount of a plurality of conveyance units is a conveyance amount obtained by subjecting the conveyance amount of each conveyance unit to weighted average with difficulty of slipping of each conveyance unit to a load as a weighting coefficient".

In the first exemplary embodiment, the example of conveyance roller rotation:discharge roller rotation:idler gear rotation=1:1:1 is described in detail. However, the present invention can be applied to the other rotational speed ratio.

When a recording medium is conveyed only by the conveyance roller 36, the conveyance roller 36 is designed so that the recording medium is conveyed by a predetermined distance ILLF by rotating the conveyance roller 36 by θLF. More specifically, the radius of the conveyance roller 36 is determined. When the conveyance roller 36 is rotated by θLF, the rotational speed ratio in design between the conveyance roller 36 and the discharge roller 40 is set so that the discharge roller 40 is rotated by θEJ. Further, the discharge roller 40 is designed so that the recording medium is conveyed by the conveyance amount ILLF by rotating the discharge roller 40 by θEJ when the recording medium is conveyed only by the discharge roller 40. When both the conveyance roller 36 and the discharge roller 40 simultaneously convey the recording medium, the recording medium is conveyed by the conveyance amount ILLFEJ in the case where the conveyance roller 36 is rotated by θLF and the discharge roller 40 is rotated by θEJ.

The actual measured value of the conveyance amount in the case where the conveyance roller 36 is rotated by θLF when the recording medium is conveyed only by the conveyance roller 36 is defined as TLLF. Similarly, the actual measured value of the conveyance amount in the case where the discharge roller 40 is rotated by θEJ when the recording medium is conveyed only by the discharge roller 40 is defined as TLEJ. The actual measured value of the conveyance amount in the case where the conveyance roller 36 is rotated by θLF and the discharge roller 40 is rotated by θEJ when the recording medium is conveyed by the conveyance roller 36 and the discharge roller 40 is defined as TLLFEJ. A difference between the actual measured value of the conveyance amount and the ideal conveyance amount is a correction value. When the correction values in the case where the recording medium is conveyed only by the conveyance roller 36, only by the discharge roller 40, and by the conveyance roller 36 and the discharge roller 40 are respectively defined as SLLF, SLEJ, and SLLFEJ, the relationships of formulae 17, 18, and 19 are set.

$$SLLF=ILLF-TLLF \quad \text{(formula 17)}$$

$$SLLFEJ=ILLFEJ-TLLFEJ \quad \text{(formula 18)}$$

$$SLEJ=ILEJ-TLEJ \quad \text{(formula 19)}$$

When the formulae 17, 18, and 19 are modified as in formulae 20, 21, and 22, and are substituted for the formula 4, the relationship of a formula 23 can be derived.

$$TLLF=ILLF-SLLF \quad \text{(formula 20)}$$

$$TLLFEJ=ILLFEJ-SLLFEJ \quad \text{(formula 21)}$$

$$TLEJ=ILEJ-SLEJ \quad \text{(formula 22)}$$

$$(ITLLFEJ-SLLFEJ)=(\gamma LF/(\gamma LF+\gamma EJ))\times(ITLF-SLLF)+(\gamma EJ/(\gamma LF+\gamma EJ))\times(ITLEJ-SLEJ) \quad \text{(formula 23)}$$

The ideal conveyance amounts ITLF, ITEJ, and ITLFEJ meet the relationship of a formula 24.

$$ITLLFEJ=(\gamma LF/(\gamma LF+\gamma EJ))\times ITLF+(\gamma EJ/(\gamma LF+\gamma EJ))\times ITLEJ \quad \text{(formula 24)}$$

When the formula 24 is substituted for the formula 23, the relationship of a formula 25 is derived.

$$SLLFEJ=(\gamma LF/(\gamma LF+\gamma EJ))\times SLLF+(\gamma EJ/(\gamma LF+\gamma EJ))\times SLEJ \quad \text{(formula 25)}$$

More specifically, the correction value when the recording medium is conveyed by both the conveyance roller 36 and the discharge roller 40 can be calculated by subjecting the correction value when the recording medium is conveyed by each individual roller to weighted average using the conveyance strength of each roller as weight. The conveyance strength (i.e., difficulty of slipping) of each roller is $\gamma LF$ ($=1/\alpha LF$) and $\gamma EJ$ ($=1/\alpha EJ$).

If the two correction values among the correction values SLLF, SLEJ, and SLLFEJ are obtained by actual measurement of the conveyance amount, the remaining correction value can be calculated using the formula 11 or 13.

The control by the flowchart in FIG. 7 is performed using the thus obtained correction value.

When the recording medium is conveyed by the conveyance amount ILLF only by the conveyance roller 36, the conveyance roller 36 is driven by $\{(1+SLLF/ILLF)\times\theta LF\}$. When the recording medium is conveyed by the conveyance amount ILEJ only by the discharge roller 40, the discharge roller 40 is driven by $\{(1+SLEJ/ILEJ)\times EJ\}$. When the recording medium is conveyed by the conveyance amount ILLFEJ by both the conveyance roller 36 and the discharge roller 40, the conveyance roller 36 and the discharge roller 40 are respectively rotated by $\{(1+SLLFEJ/ILLFEJ)\times\theta LF\}$ and $\{(1+SLLFEJ/ILLFEJ)\times EJ\}$.

The rotation angle of the roller of the required conveyance amount may be obtained based on these values, and may be corrected.

Thus, a conveyance amount in an unknown conveyance state can be calculated from the conveyance amount in the known conveyance state. Because the calculation formula used to calculate the conveyance amount is based on the relational formula of the conveyance amount of each conveyance unit, the correction accuracy of the conveyance amount is not decreased. Therefore, the above-described exemplary embodiments can shorten a measurement time without impairing the correction accuracy compared with the conventional technique which actually measures and corrects the conveyance amounts in all the conveyance states.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-203097 filed Sep. 14, 2012, which is hereby incorporated by reference herein in its entirety.

What is claimed is:

1. A conveyance apparatus to determine a correction value for conveyance, the conveyance apparatus comprising:

a first conveyance unit configured to convey a sheet in a conveyance direction; and a second conveyance unit disposed at a position downstream of the conveyance direction from the first conveyance unit and configured to convey the sheet in the conveyance direction, wherein, in a case where the sheet is conveyed only by the first conveyance unit, a first conveyance amount is obtained, wherein, in a case where the sheet is conveyed only by the second conveyance unit, a second conveyance amount is obtained, and wherein, in a case where a sheet is conveyed by both the first conveyance unit and the second conveyance unit, cooperative conveyance amount is obtained by subjecting the first conveyance amount and the second conveyance amount to weighted average, where difficulty of slipping of the first or second conveyance unit to the sheet is used as a weighting coefficient in the weighted average, wherein, based on the cooperative conveyance amount, a remaining conveyance amount is calculated from any two conveyance amounts, wherein the two conveyance amounts are from among (i) the cooperative conveyance amount, (ii) the first conveyance amount, and (iii) the second conveyance amount, and wherein a correction value for conveyance is set from the calculated remaining conveyance amount.

2. The conveyance apparatus according to claim 1, wherein, (A) in a case where (i) a state where a sheet is conveyed only by the first conveyance unit is defined as a first conveyance state, (ii) a state where the sheet is conveyed by both the first conveyance unit and the second conveyance unit is defined as a second conveyance state, and (iii) a state where the sheet is conveyed only by the second conveyance unit is defined as a third conveyance state such that (iv) the cooperative conveyance amount of the sheet in the second conveyance state is obtained by subjecting the first conveyance amount of the sheet in the first conveyance state and the second conveyance amount of the sheet in the third conveyance state to weighted average where difficulty of slipping of the first conveyance unit and the second conveyance unit to the sheet is used as a weighting coefficient in the weighted average, (B) two conveyance amounts in any two states among the first, second, and third conveyance states are actually measured, a remaining conveyance amount in a remaining conveyance state of the first, second, and third conveyance states is calculated, as a calculated conveyance amount, from the actually measured conveyance amounts, and a correction value for conveyance in the remaining conveyance state is set from the calculated remaining conveyance amount.

3. The conveyance apparatus according to claim 2, wherein a correction value in a conveyance state where a conveyance amount is actually measured is set based on the actually measured conveyance amount.

4. A conveyance apparatus to determine a correction value for conveyance, the conveyance apparatus comprising:

a first conveyance unit configured to convey a sheet in a conveyance direction; and a second conveyance unit disposed at a position downstream of the conveyance direction from the first conveyance unit and configured to convey the sheet in the conveyance direction, wherein, (A) in a case where (i) a state where a sheet is conveyed only by the first conveyance unit is defined as a first conveyance state with a first conveyance amount, (ii) a state where the sheet is conveyed by both the first conveyance unit and the second conveyance unit is defined as a second conveyance state with a cooperative conveyance amount, and (iii) a state where the sheet is conveyed only by the second conveyance unit is defined as a third conveyance state with a second conveyance amount such that (iv) the cooperative conveyance amount of the sheet in the second conveyance state is obtained by subjecting the first conveyance amount of the sheet in the first conveyance state and the second conveyance amount of the sheet in the third conveyance state to weighted average such that a correction value of the cooperative conveyance amount of the sheet in the second conveyance state is a obtained as a correction value by subjecting a correction value of the first conveyance amount and a correction value of the second conveyance amount to weighted average where difficulty of slipping of the first conveyance unit and the second conveyance unit to the sheet is used as a weighting coefficient in the weighted average, (B) two correction values of the conveyance amounts in any two states among the first, second, and third conveyance states are calculated from actually measured values of the conveyance amounts, and a correction value for conveyance in the remaining conveyance state is calculated from the calculated correction values.

5. A recording apparatus to determine a correction value for conveyance, the conveyance apparatus comprising:

a first conveyance unit configured to convey a sheet in a conveyance direction;

a second conveyance unit disposed at a position downstream of the conveyance direction from the first conveyance unit and configured to convey the sheet in the conveyance direction; and a recording unit disposed between the first conveyance unit and the second conveyance unit and configured to perform recording on the sheet conveyed by the first conveyance unit and the second conveyance unit, wherein, (A) in a case where (i) a state where a sheet is conveyed only by the first conveyance unit is defined as a first conveyance state with a first conveyance amount, (ii) a state where the sheet is conveyed by both the first conveyance unit and the second conveyance unit is defined as a second conveyance state with a cooperative conveyance amount, and (iii) a state where the sheet is conveyed only by the second conveyance unit is defined as a third conveyance state with a second conveyance amount such that (iv) the cooperative conveyance amount of the sheet in the second conveyance state is a correction value obtained by subjecting a correction value of the first conveyance amount and a correction value of the second conveyance amount to weighted average where difficulty of slipping of the first conveyance unit and the second conveyance unit to the sheet is used as a weighting coefficient in the weighted average, (B) two correction values of the conveyance amounts in any two states among the first, second, and third conveyance states are calculated from actually measured values of the conveyance amounts, and a correction value for conveyance in the remaining conveyance state is calculated from the calculated correction values.

6. A conveyance apparatus to determine a correction value for conveyance, the conveyance apparatus comprising:

a plurality of conveyance units arranged in a conveyance direction of a sheet, wherein, from among conveyance amounts in conveyance states of all combinations of two or more conveyance units configured to cooperatively convey a sheet among the plurality of conveyance units, and a conveyance amount in a conveyance state of each individual conveyance unit, the conveyance amounts, corresponding to a number of the conveyance units, are obtained by actual measurement, and wherein a remaining conveyance amount, in remaining conveyance states of all combinations of two or more conveyance units configured to cooperatively convey a sheet among the plurality of conveyance units, is calculated, in a case where a sheet is conveyed by each individual conveyance unit, using (i) a conveyance amount obtained by subjecting a conveyance amount to weighted average, where difficulty of slipping of each conveyance unit to the sheet is used as a weighting coefficient in the weighted average, and wherein a correction value for conveyance in the remaining conveyance state is set from the calculated remaining conveyance amount.

7. A conveyance apparatus to determine a correction value for conveyance, the conveyance apparatus comprising:

n pieces of conveyance units arranged in a conveyance direction of a sheet, wherein, from among conveyance amounts in conveyance states of all combinations of two or more conveyance units configured to cooperatively convey a sheet among the n pieces of conveyance units, and a conveyance amount in a conveyance state of each individual conveyance unit, n pieces of conveyance amounts are obtained by actual measurement, and wherein a remaining conveyance amount in remaining conveyance states is calculated, in a case where a sheet is conveyed by each individual conveyance unit, based on a conveyance amount obtained by subjecting a conveyance amount to weighted average, where difficulty of slipping of each conveyance unit to the sheet is used as a weighting coefficient in the weighted average, and a correction value for conveyance in the remaining conveyance state is set from the calculated remaining conveyance amount.

8. A method for determining a correction value for conveyance of a conveyance apparatus, wherein the conveyance apparatus includes a first conveyance unit configured to convey a sheet in a conveyance direction, and a second conveyance unit disposed at a position downstream of the conveyance direction from the first conveyance unit and configured to convey the sheet in the conveyance direction, the method comprising:

actually measuring any two conveyance amounts from among a cooperative conveyance, a first conveyance amount, and a second conveyance amount, wherein the cooperative conveyance amount is in a case where a sheet is conveyed by both the first conveyance unit and the second conveyance unit, the first conveyance amount is in a case where the sheet is conveyed only by the first conveyance unit, and the second conveyance amount is in a case where the sheet is conveyed only by the second conveyance unit;

calculating a remaining conveyance amount from the actually measured conveyance amounts based on the cooperative conveyance amount, where the cooperative conveyance amount is a conveyance amount obtained by subjecting the first conveyance amount and the second conveyance amount to weighted average, where difficulty of slipping of the first or second conveyance unit to the sheet is used as a weighting coefficient in the weighted average; and calculating a correction value for conveyance from the calculated remaining conveyance amount.

9. A method for determining a correction value for conveyance of a conveyance apparatus including n pieces of conveyance units arranged in a conveyance direction of a sheet, the method comprising:

obtaining n pieces of conveyance amounts are obtained by actual measurement from among conveyance amounts in conveyance states of all combinations of two or more conveyance units configured to cooperatively convey a sheet among the n pieces of conveyance units, and a conveyance amount in a conveyance state of each individual conveyance unit; and calculating, in a case where a sheet is conveyed by each individual conveyance unit a remaining conveyance amount in remaining conveyance states based on a conveyance amount obtained by subjecting a conveyance amount to weighted average, where difficulty of slipping of each conveyance unit to the sheet is used as a weighting coefficient in the weighted average; and setting a correction value for conveyance in the remaining conveyance state from the calculated remaining conveyance amount.

* * * * *